United States Patent [19]

Deeg

[11] 4,019,164

[45] Apr. 19, 1977

[54] MEMORY MATRIX

[75] Inventor: Wyman L. Deeg, Vernon Hills, Ill.

[73] Assignee: C. P. Clare & Company, Chicago, Ill.

[22] Filed: Dec. 3, 1975

[21] Appl. No.: 637,389

[52] U.S. Cl. ..... 335/112; 200/175

[51] Int. Cl.[2] ..... H01H 67/14

[58] Field of Search ..... 335/111, 112, 152; 200/175

[56] References Cited

UNITED STATES PATENTS

| | | | |
|---|---|---|---|
| 2,397,123 | 3/1946 | Brown | 335/152 |
| 3,439,301 | 4/1969 | Kudo et al. | 335/112 |
| 3,500,267 | 3/1970 | Wasserman | 335/112 |

*Primary Examiner*—George Harris

*Attorney, Agent, or Firm*—Mason, Kolehmainen, Rathburn & Wyss

[57] ABSTRACT

A cross point switching matrix utilizing remanent reed switches includes an array of coil forms mounted on a magnetically permeable shunt plate. Electromagnetic coils are wound around the coil forms in alternating directions and one or more remanent reed switches are contained in each coil. Magnetically permeable coupler plates are mounted on opposite sides of the shunt plates and serve to complete a magnetic path between the ends of each reed switch and the shunt plate through the other reed switches. When two or more reed switches are mounted in each coil, the switches are disposed in a straight line aligned at a 45° angle to the coordinates of the matrix to permit electrical connections to be readily made to the reed switches utilizing straight conductors.

18 Claims, 13 Drawing Figures

Fig. 8
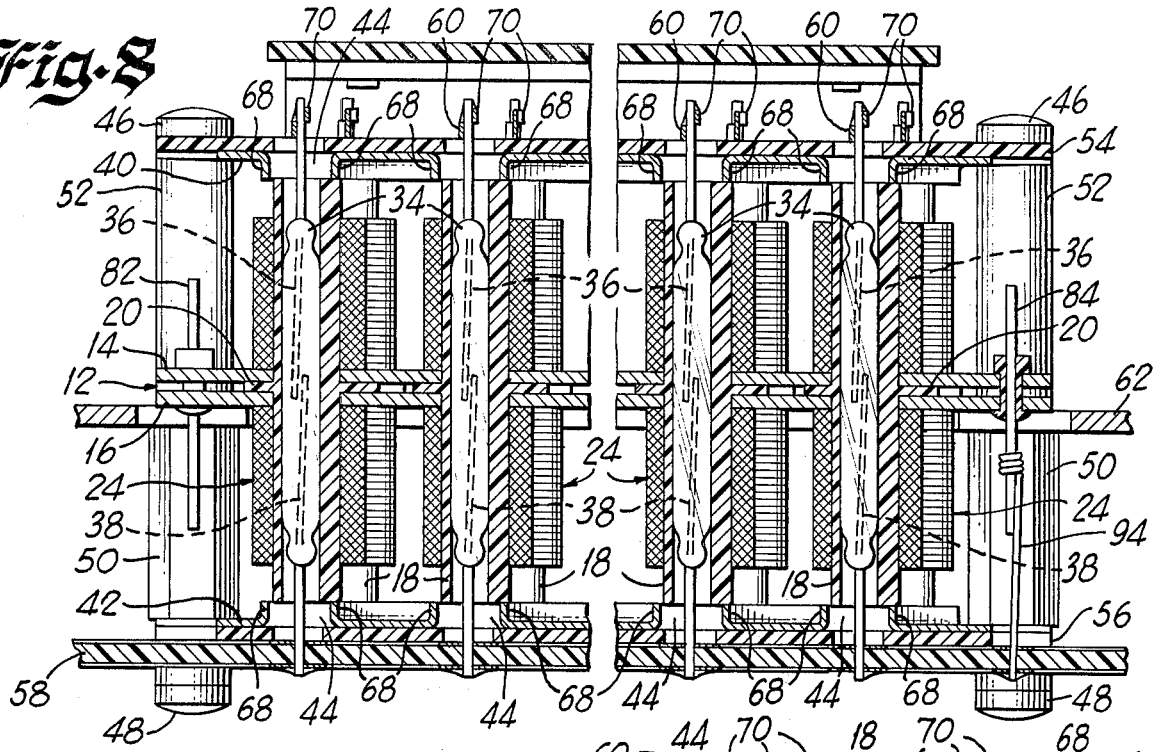
Fig. 9
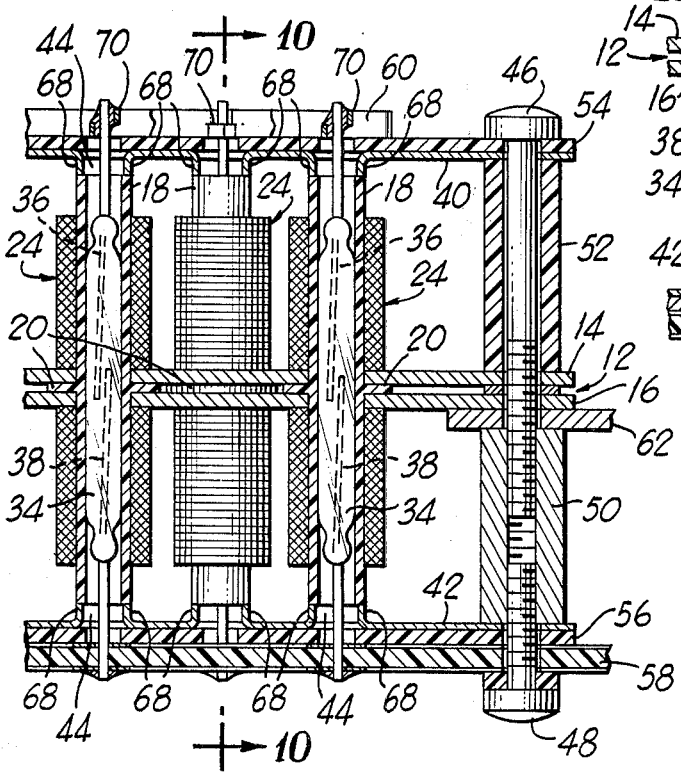
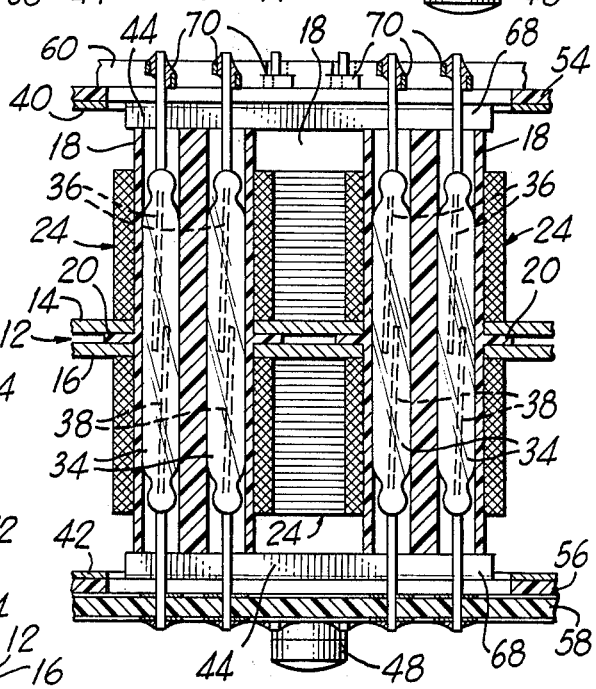
Fig. 10

82
88
14
22
18
20
16
46
54
68
44
40
52
62
50
42
56
58
48
12

MEMORY MATRIX

BACKGROUND OF THE INVENTION

This invention relates generally to switching systems, and more particularly, to cross point switching arrays utilizing remanent reed switches.

Several remanent reed switch cross point switching matrices are known; however, common to the known switching matrices is the problem of magnetic interaction between adjacent switches in the matrix. In an attempt to reduce the magnetic interaction between adjacent switches, magnetic shields between adjacent switches and high permeability magnetic paths around individual switches have been utilized to minimize flux leakage. The high permeability path is generally provided by passing the remanent reed switches through a shunt plate so that the magnetic flux is concentrated by the shunt plate at the contact gap in the reed switch. The magnetic path between the ends of the reed switch and the shunt plate is completed by a magnetic structure, such as yoke, magnetically coupling the shunt plate to the ends of the reed switches, or through the use of ferromagnetic leads that serve both to interconnect the reed switches electrically and provide a magnetic path between the reed switches. Typical prior art cross point switching devices are illustrated in U.S. Pat. Nos. 3,789,332 and 3,439,301.

While the prior art switching devices provide a way to achieve cross point switching with very little magnetic interaction between switches, the use of magnetic shields and yokes results in a relatively large,, complex and costly structure, while ferromagnetic leads are difficult to solder thereby resulting in a structure that is difficult to manufacture and repair.

Accordingly, it is an object of the present invention to provide a reed switch cross point matrix assembly that overcomes many of disadvantages of the prior art matrix assemblies.

It is another object of the present invention to provide a cross point matrix assembly that eliminates the need for ferromagnetic yoke, ferromagnetic leads or magnetic shields to minimize interaction between adjacent switches.

It is yet another object of the present invention to provide a compact cross point switching matrix that is relatively simple and inexpensive to fabricate.

In accordance with a preferred embodiment of the invention, a plurality of coil forms are mounted on a magnetic shunt plate. Electromagnetic coils are wound around the coil forms, with the windings of adjacent coil forms being wound in opposite direction. A plurality of remanent reed switches are arranged in a straight line disposed at a 45° angle with respect to the coordinates of the matrix.

The ends of the reed switches pass through a pair of "potato grater" end plates fabricated from a magnetically permeable material and disposed on opposite sides of the shunt plate to provide a high permeability magnetic path between the ends of the reed switches. The end plates serve as magnetic coupling plates between switches to minimize flux leakage, thereby permitting the reed switches to be placed close together without causing interaction.

Electrical connection to the reed switches is made on one side of the assembly by a plurality of parallel conductors interconnecting the reed switches in each row. Connection to the other side of the switches is made by a second plurality of parallel conductors running in a direction perpendicular to the first conductors and interconnecting the switches in each column. The interconnecting conductors may be conductive straps, wires or printed circuit conductors.

The other objects and advantages of the present invention will be readily apparent from the following specification and attached drawings wherein.

Figure 1:
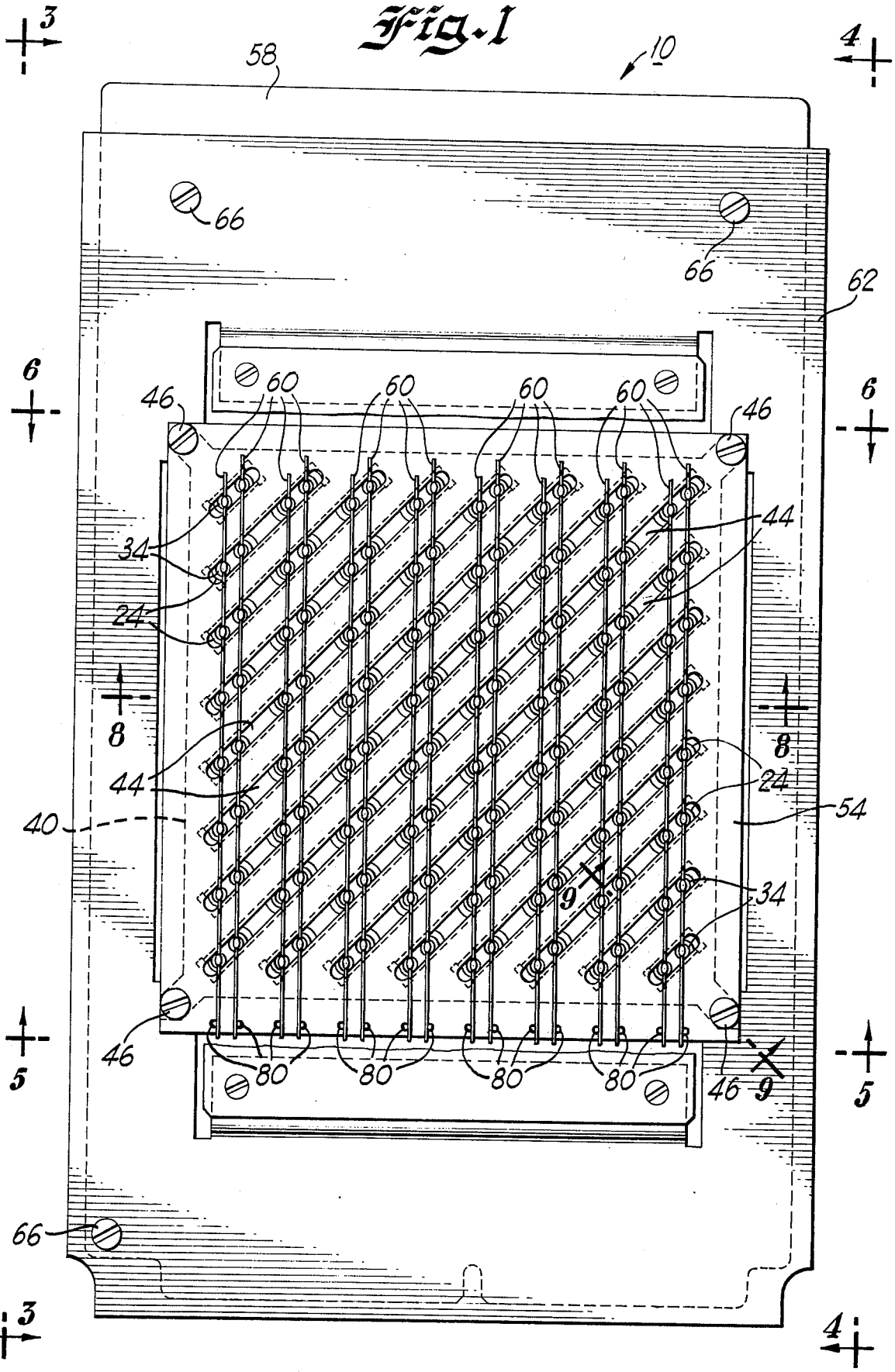
FIG. 1 is a top plan view of a preferred embodiment of the reed switch cross point switching assembly according to the invention.
Figures 11, 12:
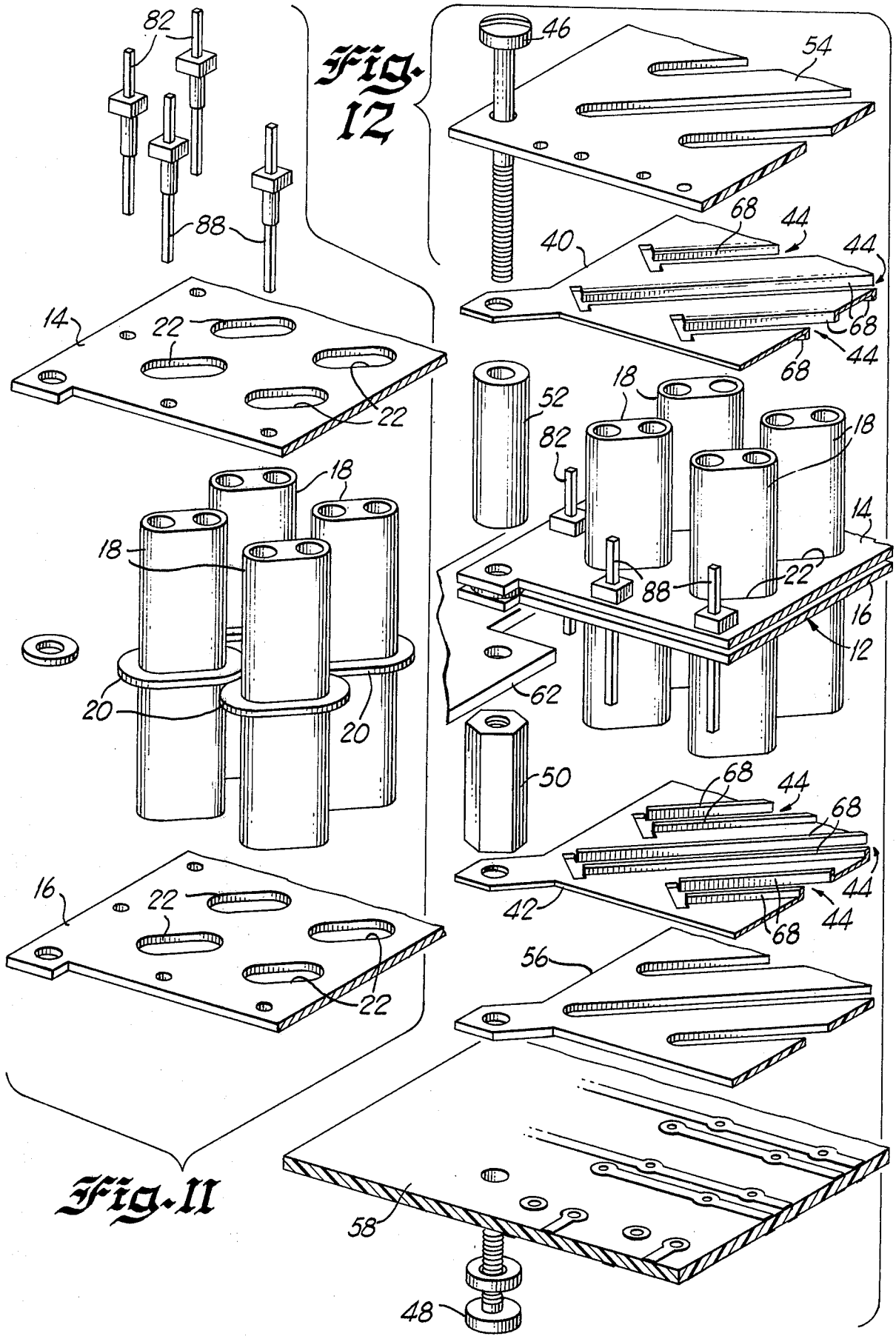
Figure 13:
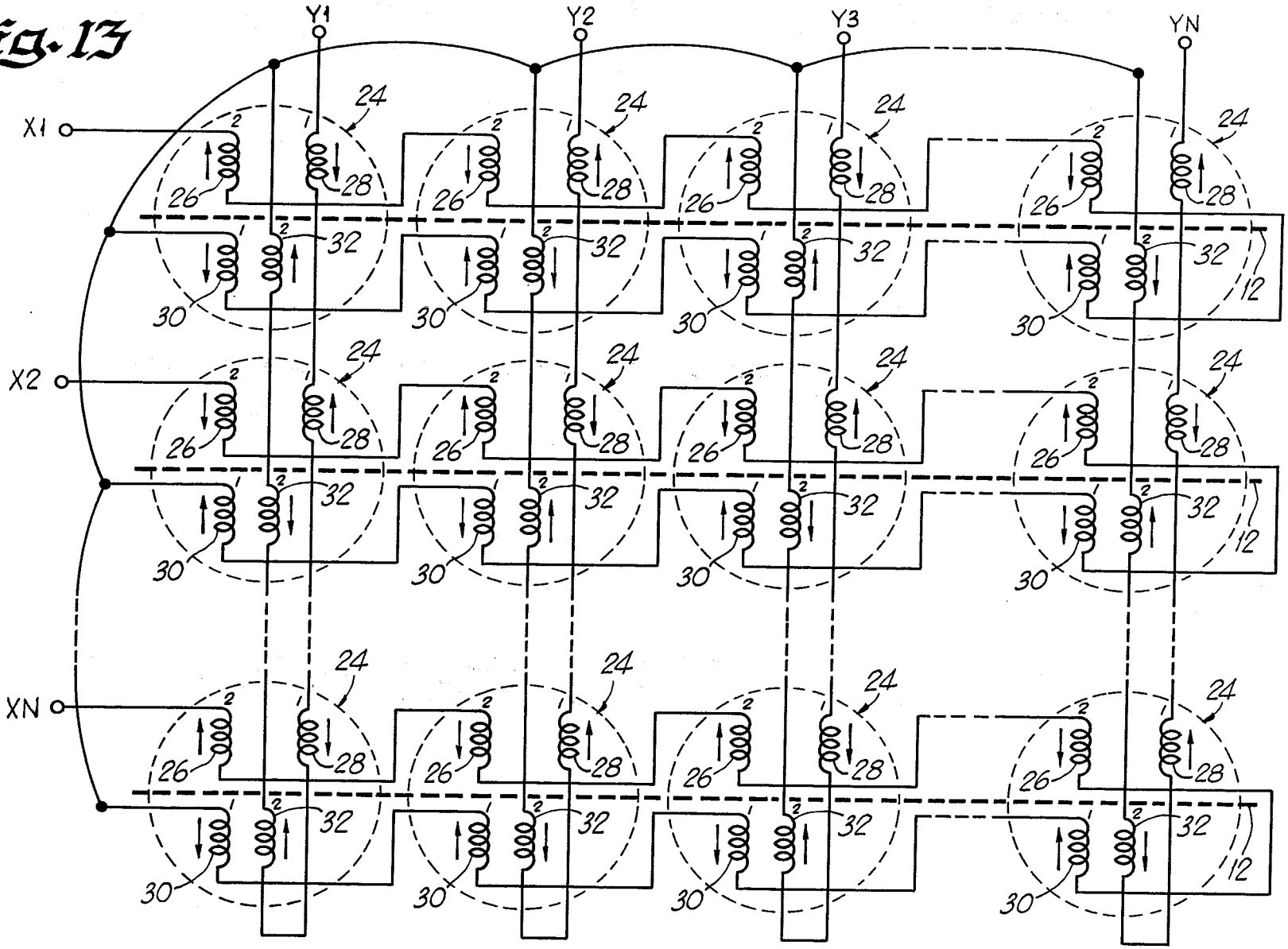

FIGS. 8 and 9 are detailed sectional views taken along lines 8—8 and 9—9 of FIG. 1, respectively;

FIG. 10 is a detailed sectional view taken along line 10—10 of FIG. 9;

FIG. 11 is an exploded perspective view showing the mounting of the coil forms within the shunt plate;

FIG. 12 is an exploded perspective view showing the mounting of the coupling plates at opposite sides of the shunt plate; and FIG. 13 is a detailed schematic diagram showing the electrical interconnection of the electromagnetic coils that control the switching array.

DETAILED DESCRIPTION OF THE INVENTION

Figure 3:
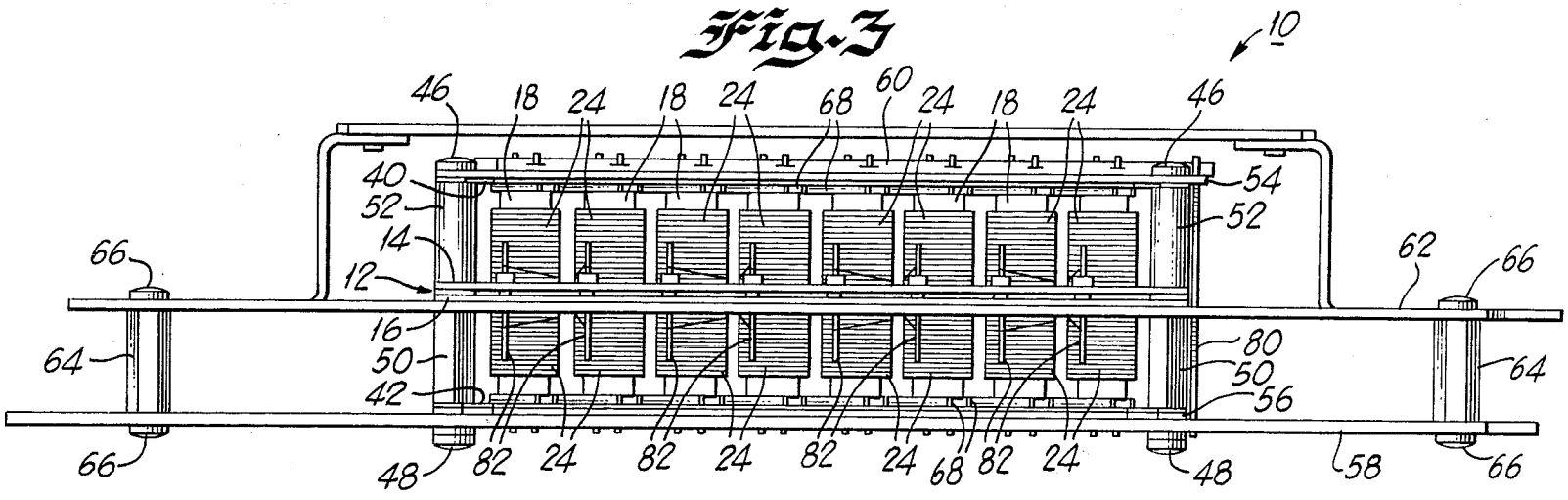
FIG. 3 is a side view of the switching assembly taken along line 3—3 of FIG. 1.
Figure 4:
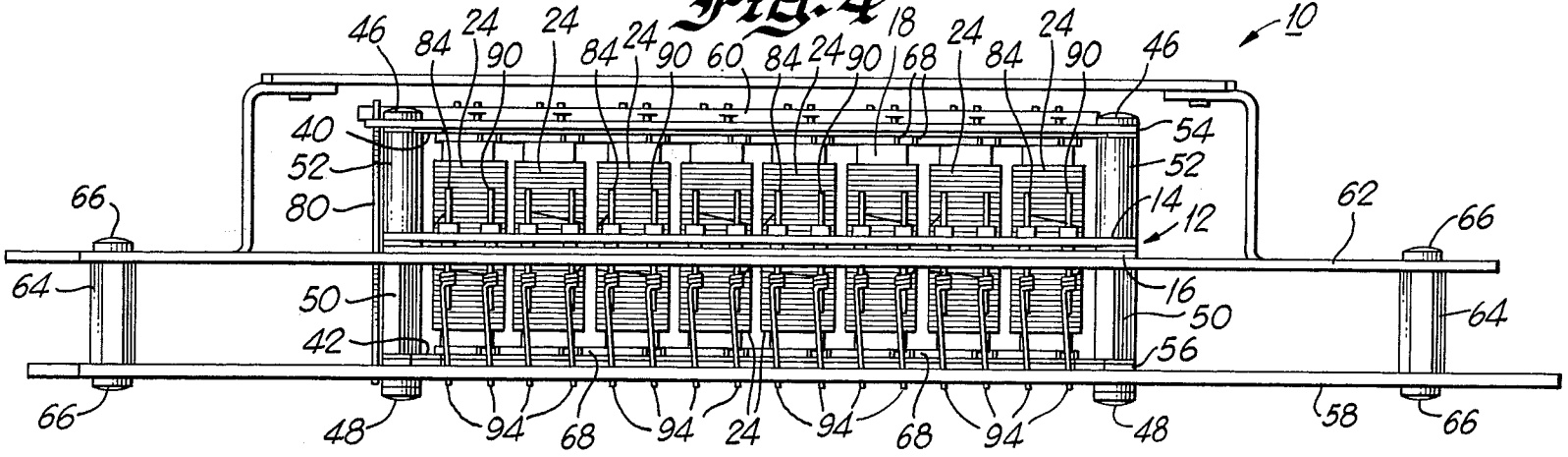
FIG. 4 is another side view of the switching assembly taken along line 4—4 of FIG. 1.

Referring now to the drawings, with particular attention to FIGS. 1, 3 and 4, there is shown a cross point reed switch assembly according to the invention generally designated by the reference numeral 10. The assembly 10 includes a shunt place 12 formed by two separate plates 14 and 16, each fabricated from a magnetically permeable material, such as cold rolled steel. A plurality of coil forms 18, each having an integrally molded flange 20, are received in a plurality of elongated apertures 22 formed in the plates 14 and 16 (FIGS. 11 and 12). The flanges are larger than the apertures 22 and are retained between the plates 14 and 16 and serve to mount the coil forms 18 to the shunt plate 12.

A plurality of series connected coils 24 are wound around the coil forms 18 on both sides of the shunt plate 12. The coils 24 may be wound by a coil winding machine having an elliptically moving winding head such as the machine described in U.S. Pat. application Ser. No. 637,388 entitled "Coil Winding Machine" filed by the same inventor on the same date as the present application, and incorporated herein by reference. A machine of the type described in the referenced application is particularly useful for winding closely spaced, noncircular coils of the type utilized in the matrix assembly of the present invention.

The coils on one side of the shunt plate 12 each contain an X-winding 26 and a Y-winding 28. The X-windings 26 contain twice as many turns as the Y-windings 28. The windings 26 and 28 (FIG. 13), forming each coil are wound so that flux generated by each of the windings 28 opposes the magnetic flux generated by the winding 26 wound on the same coil form 18, as indicated by the oppositely directed arrows. The windings 26 and 28 forming adjacent coils 24 are wound in opposite directions so that each coil 24 develops a series aiding return path for an adjacent coil 24.

The windings forming the coil 24 on the opposite side of the shunt plate 12 include an X-winding 30 and a Y-winding 32. The X-winding 30 has the same number of turns as the Y-winding 28, and the Y-winding 32 has the same number of windings as the X-winding 26. Therefore, the coils 26 on one side of the shunt plate 12 have X-windings 26 with twice as many turns as the Y-windings 28, while the coils 24 on the opposite side of the shunt plate 12 have Y-windings 32 with twice as many turns as the X-windings 30. As in the case of the X- and Y-windings 26 and 28, the X- and Y-windings 30 and 32 are wound to generate opposite polarity magnetic fields, and the X- and Y-winding 30 and 32 forming adjacent coils are wound in opposite directions to form a series aiding magnetic return path between adjacent coils 24. The X-windings 26 and 30 in each row are connected in series and the Y-windings 28 and 32 in each column are connected in series.

A plurality of reed switches 34 having remanently magnetizable contacts 36 and 38 are inserted into the coil forms 18 and positioned so that the gap between the contacts 36 and 38 is positioned within the aperture 22 of the shunt plate 12. The contacts 36 and 38 of the remanent reed 34 are made of a magnetizable material so that if the contacts 36 and 38 are magnetized with adjacent ends having unlike polarity, the contacts will attract and remain closed even after the coil 24 has been deenergized. The contacts 36 and 38 are opened by magnetizing them so that the adjacent ends having a like magnetic polarity, thereby causing the contacts 36 and 38 to repel each other and to open. A remanent red switch usable as the reed switch 34 is described in U.S. Pat. Nos. 3,059,075 and 3,037,085, incorporated herein by reference.

The operation of the circuit of FIG. 13 is described in detail in U.S. Pat. No. 3,110,772; however, a brief description of the operation of the circuit will be given to provide a better understanding of the present invention. Briefly, only the reed switches 34 contained in a single one of the coil forms 18 can be closed at any given time. The closing of the reed switches 34 contained in a particular coil form 18 is accomplished by energizing both the X-windings and the Y-windings wound around the coil form 18 containing the reed switches that are to be closed. For example, if it is desired to close the reed switch controlled by the windings in the upper left hand corner of the circuit of FIG. 13, the input terminals X1 and Y1 are energized. This causes the winding 26 to generate a magnetic flux in a direction indicated by the upwardly directed arrow and a second magnetic flux to be generated by the Y-winding 28 in a direction indicated by the downwardly directed arrow. Since the winding 26 has twice as many windings as the winding 28, only half of the upwardly directed flux is cancelled by the flux generated by the winding 28, and the polarity of the resultant flux is the same as that generated by the X-winding 26. In a similar fashion, the flux generated by the X-winding 30 cancels one half of the flux generated by the Y-winding 32 thereby providing a resultant flux having a direction indicated by an upwardly directed arrow. Since the resultant fluxes generated by the coils 24 on opposite sides of the shunt plate 12 are series aiding, the contacts 36 and 38 are magnetized with their adjacent ends having unlike polarity, and the contacts 36 and 38 are magnetically attracted. Because the contacts 36 and 38 have been permanently magnetized, the contacts remain closed even after all of the windings have been deenergized.

When it is desired to close the reed switches controlled by another one of the coils 24, for example by energizing the terminals X1 and Y2, the energization of the windings connected to the terminals X1 and Y2 closes the reed switch 34 located directly adjacent the reed switch previously closed, and the previously closed reed switch 34 is opened by energizing only the X-windings (or only the Y-windings) of the coils surrounding that reed switch. The opening of the previously closed switch occurs because, when only one set of windings of each coil is energized, for example the X-windings 26 and 30, the flux generated by the two X-windings 26 and 30 is series opposing. This results in the contacts 36 and 38 being magnetized with their adjacent ends having like polarity, and causes magnetic repulsion and a resultant opening of the contacts 36 and 38. The energization of only the Y-windings 28 and 32 also causes magnetic repulsion between the contacts 36 and 38 since the flux generated by the windings 28 and 32 is also opposing.

If the magnetic field generated by each of the coils 24 is not confined by the magnetic circuit to the vicinity of that coil, the repelling polarity flux generated at the contact gap of one switch (when only the X- or the Y-windings ar energized) tends to neutralize the attractive polarity magnetic field generated in an adjacent coil 24 (having both the X- and Y-windings energized). This flux leakage weakens the attractive polarity magnetic field in the gap between the contacts 36 and 38 of the adjacent switch, and increases the probability that the contacts will fail to close.

For this reason, and in accordance with an important aspect of the present invention, a pair of coupling plates 40 and 42 are disposed over the ends of the reed switches 34 at opposite ends of the coil forms 18. The magnetic coupling plates 40 and 42 are fabricated from a magnetically permeable material, such as cold rolled steel. A plurality of slots 44 are formed within the coupling plates 40 and 42 for receiving the ends of the reed switches 34. A series of long slots 44 are utilized in the present embodiment, each long enough to receive the reed switches 34 contained in several ones of the coil forms 18; however, a series of shorter slots, each having a length similar to the length of one of the slots 22 in the shunt plate 12, may be used to receive the reed switches from only a single one of the coil forms 18. Alternatively, a series of holes designated to accept only a single reed switch 34, may be used. Long slots of the type shown in the drawings are used in the present embodiment because they are relatively inexpensive to fabricate and it has been found that they provide sufficient magnetic coupling between the various reed switches 34 to avoid excessive flux leakage.

The coupling plates 40 and 42 provide a highly permeable magnetic coupling between the various reed switches 34. This coupling assures that the ends of the reed switches 34 are magnetically coupled to the shunt plate 12, and reduces the flux leakage between the magnetic circuits of adjacent switches. The coupling between the ends of each reed switch 34 and the shunt plate 12 is accomplished through a magnetic circuit comprising the coupling plates 40 and 42 and a parallel combination of several paths, including the contacts 36 and 38 of every other reed switch and eight mounting screws 46 and 48. In order to reduce the magnetic reluctance of the magnetic circuit coupling the ends of the switches 34 and the shunt plate 12, the coupling between the various reed switches 34 and the coupling plates 40 and 42 is enhanced by forming a pair of flanges 68 around each of the slots 44. The flanges 68 serve as magnetic pole pieces to increase the coupling between the coupling plates 40 and 42 and the respective contacts 36 and 38 to reduce the overall reluctance of the magnetic circuit. In addition, the flanges 68 increase the mechanical rigidity of the entire assembly 10 by increasing the stiffness of the coupling plates 40 and 42.

The coupling plates 40 and 42 are retained in position over the ends of the reed switches 34 by the eight screws 46 and 48, respectively, four nuts 50 and four spacers 52. A layer of insulating material 54 is placed over the coupling plate 40 and a second layer of insulating material 56 is placed between the coupling plate 42 and a printed circuit board 58. The insulating layer 56 serves to insulate the coupling plate 42 from the printed circuit board 58, and the insulating layer 54 serves to insulate the coupling plate 40 from a plurality of conductive straps 60 electrically interconnecting the rows of reed switches 34. The entire coil assembly is mounted to a mounting board 62 which also supports the printed circuit board 58 by means of three spacer nuts 64 and six screws 66.

In accordance with another important aspect of the invention, the various reed switches 34 are aligned in straight rows disposed at a 45° angle to the coordinates of the matrix. Although, in the illustrated embodiment, two reed switches 34 are contained in each of the coil forms 18, any number may be disposed in each coil form and disposed in a straight line at the 45° angle. The 45° angle permits interconnection between the various rows and columns of reed switches 34 to be made by straight conductors, and eliminates the need for separate interconnecting straps between the reed switches and the conductors. On one side of the matrix assembly, the connections between rows are made by the plurality of parallel straps 60 that run vertically (in FIG. 1) between various reed switches 34. This permits the straps 60 to be of a relatively simple design. In the present embodiment, the straps 60 are fabricated from strip stock having a plurality of notches 70 formed therein at spaced intervals for receiving the contacts 36, and providing a mechanical connection between the reed switches 34 and the straps 60. The straps 60 are then soldered to the contacts 36, and soldering process combined with the mechanical rigidity provided by the notches 70 results in a very strong bond between the straps 60 and the reed switches 34 to provide a more reliable electrical connection than the complicated interconnection systems of the prior art.

Figure 2:
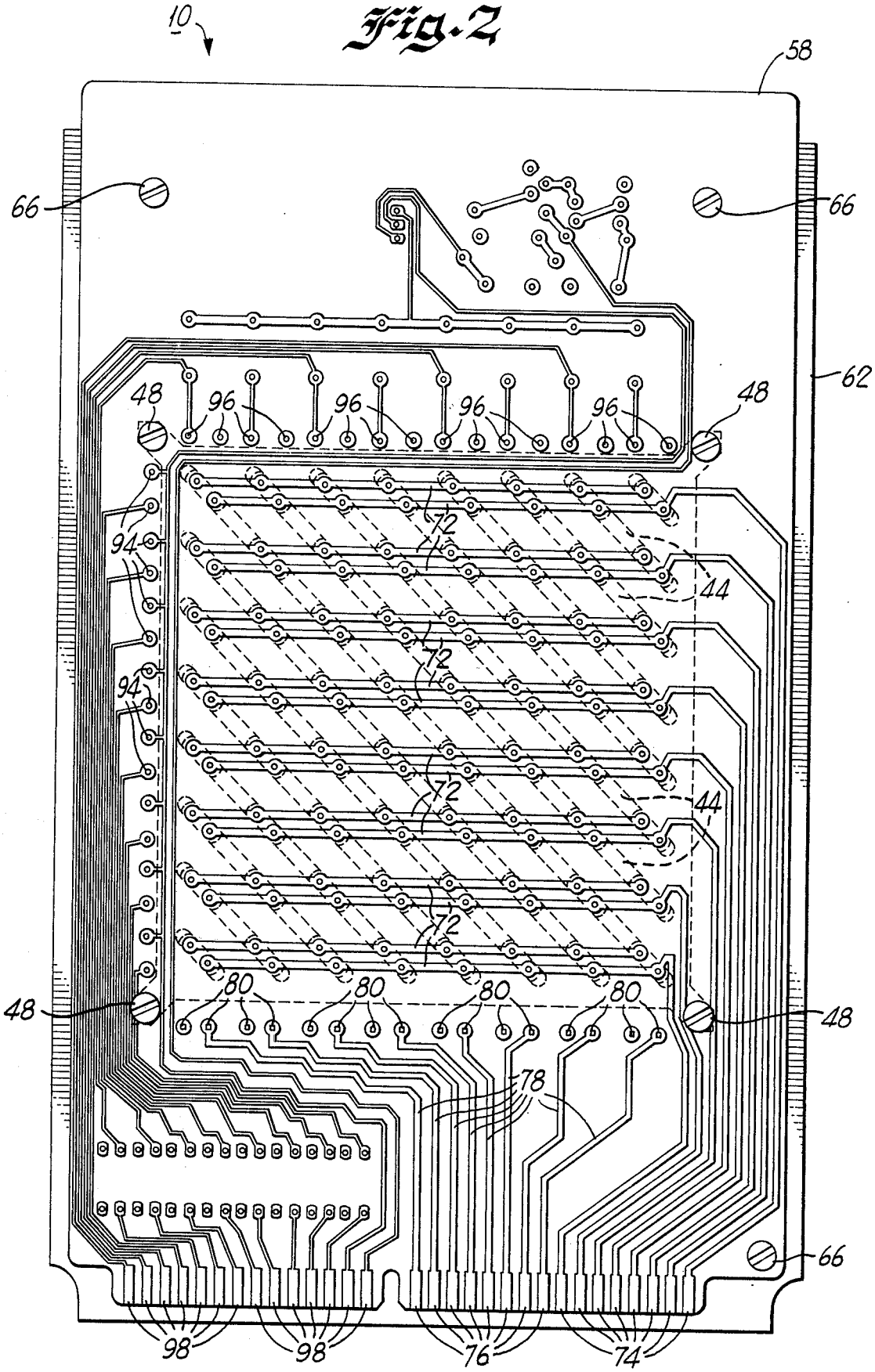
FIG. 2 is a bottom view of the switching assembly according to the invention.

The connection between the columns of reed switches 34 are made by a plurality of parallel printed circuit conductors 72 running horizontally across the printed circuit board 58 (FIG. 2). As in the case of the straps 60, the 45° orientation of the reed switches 34 results in a simple layout of the printed circuit board 58, and permits the interconnection between the columns of reed switches to be made with the straight conductors 72. Alternatively, straps such as the straps 60 could be used to make connections to both sides of the switches 34, or printed circuit boards could be used on both sides.

The combination of the printed circuit board connections interconnecting the columns of reed switches 34 and the straps 60 interconnecting the rows of reed switches 34 provides a mechanically sound assembly and permits any one of the reed switches 34 to be readily replaced in the event of failure. The replacement of any switch 34 is readily accomplished by simply removing the strap 60 connected to that switch and unsoldering the other end of the switch from the printed circuit board. The reed switch 34 may then be withdrawn through the slots in the coupling plate 40 and the insulating layer 54. The use of straps such as the straps 60 to make connections to both sides of the switches 34 would also facilitate easy removal of the switches 34.

Connections to the printed circuit conductors 72 are made by means of eight pads 74 located on one side of the printed circuit board 58, and by eight similar pads (not shown) located on the opposite side of the printed circuit board. Connections to the straps 60 are made by eight pads 76 that are connected to the straps 60 by eight printed circuit conductors 78 connected to eight of the sixteen rigid conductors 80 that passes between the printed circuit board 58 and the straps 60. The eight other rigid conductors 80 are connected to the printed circuit conductors and pads (not shown) similar to the conductors and pads 78 and 76 on the opposite side of the printed circuit board 58.

Figure 5:
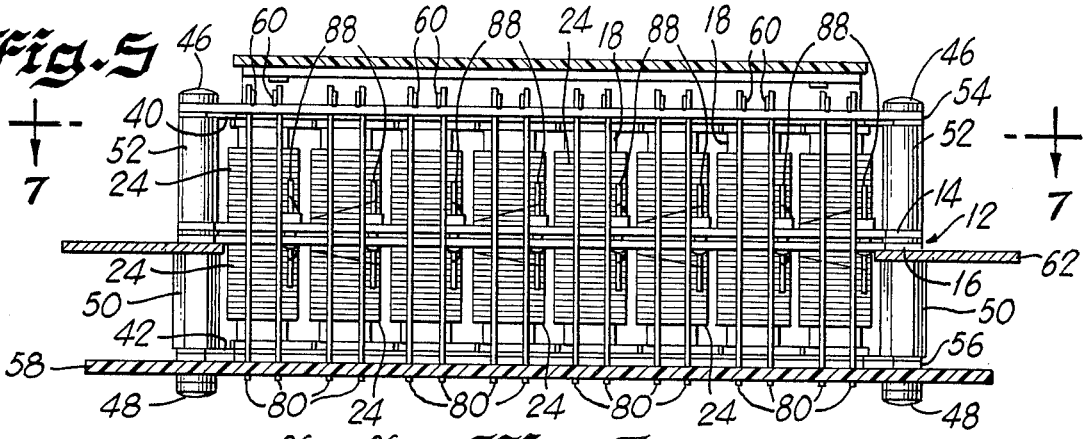
FIG. 5 is a sectional end view of the switching matrix taken along line 5—5 of FIG. 1.
Figure 7:
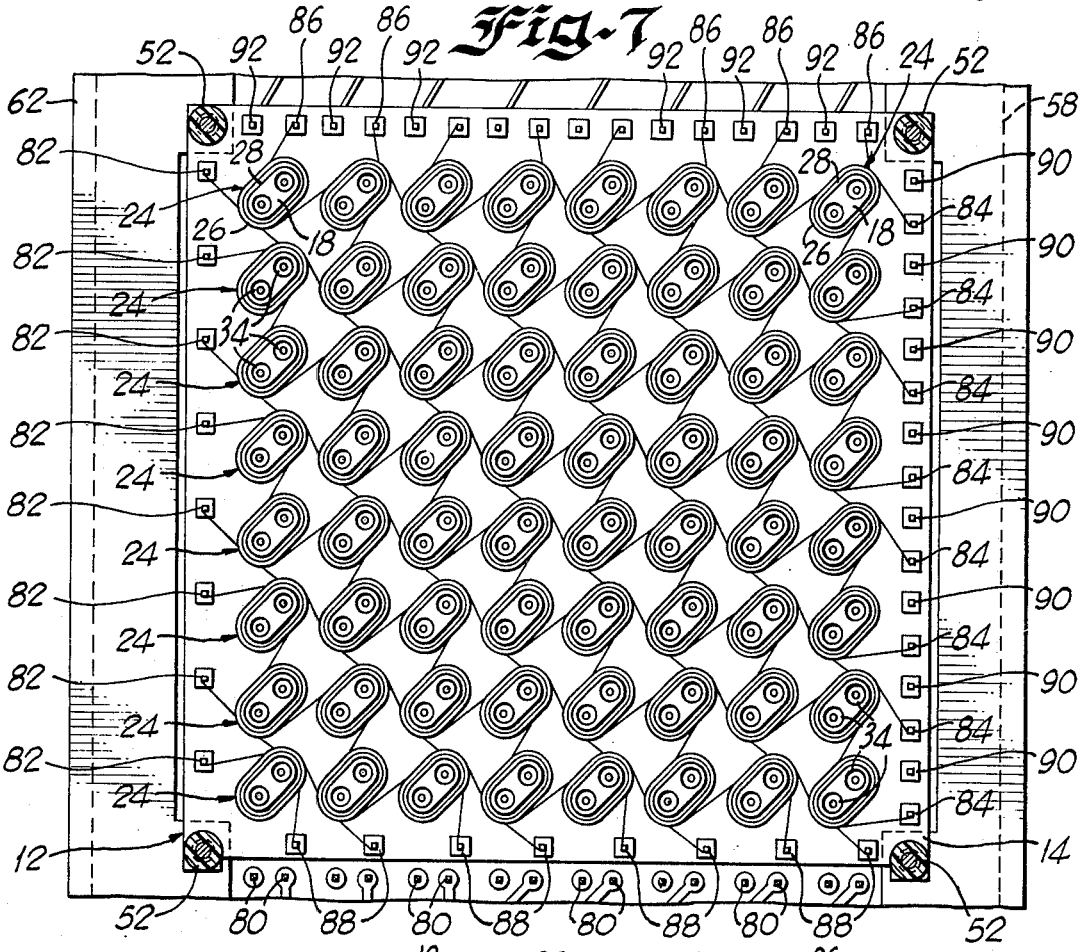
FIG. 7 is a top sectional view taken along line 7—7 of FIG. 5.
Figure 6:
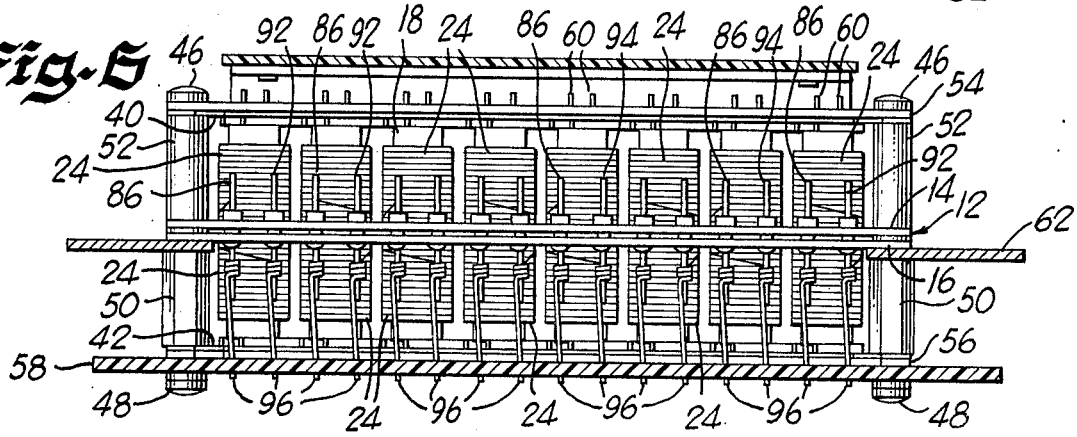
FIG. 6 is another sectional end view taken along line 6—6 of FIG. 1.

The series connection of the windings 26 and 28 of the coils 24 are best illustrated in FIG. 7. As can be seen from FIG. 7, the X-windings 26 are wound in opposite directions on horizontally adjacent ones of the coil forms 18 and serially connected between a pair of terminals 82 and 84. Similarly, the Y-windings 28 are serially wound in opposite directions on vertically adjacent ones of the coil forms 18 and connected to a pair of terminals 86 and 88. In the present embodiment, the windings 26 and 28 on each individual coil form 18 are wound in the same direction and an opposing flux is generated by energizing the windings 26 and 28 from opposite polarity voltages; however, the windings 26 and 28 could be wound in opposite directions on each individual coil form 18 and energized from like polarity voltages. The windings 30 and 32 forming the coils 24 on the opposite side of the shunt plate 12 are wound in a similar fashion (not shown). Connections between the X-windings 26 and 30 are made through the terminals 82 (FIG. 3) and the connections between the Y-windings 28 and 32 are made through the terminals 88 (FIG. 5). The X-windings are energized by energizing the terminals 84 and 90, and the Y-windings are energized by energizing the terminals 86 and 92 (FIG. 7). The terminals 84 and 90 are connected to the printed circuit board 58 by sixteen wired connections 94 (FIG. 4). Similarly, the terminals 86 and 92 are connected to the printed circuit board 58 by sixteen hard wired connections 96 (FIG. 6). The hard wired connections 94 and 96 are connected to a plurality of pads 98 on one side of the circuit board, and to other pads (not shown) on the other side of the printed circuit board by printed circuit conductors and components (not shown) on the other side of the printed circuit board. Hence, all cross points and all windings may be electrically accessed by the pads 74, 76 and the associated pads on the other side of the printed circuit board to provide a unit that can be readily plugged into a standard socket for easy installation and replacement.

While certain preferred embodiments of the invention have been described by way of illustration, many modifications will occur to those skilled in the art; it will be understood, of course, that it is not desired that the invention be limited thereto, since modifications may be made, and it is, therefore, contemplated by the appended claims to cover any such modifications as fall within the true scope and spirit of the invention.

What is claimed as new and desired to be secured by Letters Patent of the United States is:

1. A cross point switching matrix comprising:

a magnetic shunt plate having a plurality of apertures defined therein;

a plurality of reed switches disposed in said apertures and extending through said shunt plate; and a pair of magnetic coupling plates disposed on opposite sides of said shunt plate, said magnetic coupling plate having a plurality of apertures defined therein and flanges extending from said apertures, said flanges being disposed in close proximity to the ends of said reed switches for magnetically coupling said reed switches together.

2. A cross point switching matrix as recited in claim 1 wherein said magnetic coupling plates are fabricated from cold rolled steel.

3. A cross point swiching matrix as recited in claim 1 further including a plurality of coil forms extending through said aperture and surrounding said reed switches.

4. A cross point switching matrix as recited in claim 3 wherein each of said coil forms has a flange extending therefrom and wherein said shunt plate is fabricated from first and second parallel apertured plates, the flanges of said coil forms being retained between said first and second parallel apertured plates and serving to mount said coil forms within said shunt plate.

5. A cross point switching matrix as recited in claim 3 wherein said reed switches are disposed in a rectangular array and wherein each of said coil forms contains a plurality of reed switches aligned in a straight line disposed at substantially a 45° angle to the coordinates of said array.

6. A cross point switching matrix as recited in claim 5 wherein said reed switches are interconnected by substantially straight conductors.

7. A cross point switching matrix as recited in claim 6 wherein said reed switches contain magnetizable contacts.

8. A cross point switching matrix as recited in claim 7 wherein said reed switches are interconnected by a plurality of parallel conductive straps soldered to the ends of said reed switches.

9. A cross point switching matrix as recited in claim 7 further including a printed circuit board disposed adjacent to one of said magnetic coupling plates, said printed circuit board having apertures defined therein for receiving the ends of said reed switches and a plurality of conductors plated thereon interconnecting said reed switches.

10. A cross point switching matrix as recited in claim 7 wherein each of said coil forms has a pair of electrically isolated coils wound thereon, the simultaneous electrical energization of said coils being operative to close the contacts of the reed switches encircled by the energized coils, and the energization of a single one of said coils being operative to open the contacts of the encircled reed switches.

11. A method for fabricating a cross point switching matrix comprising the steps of:

forming a plurality of flanged coil forms;

inserting the flanged coil forms into apertures formed in a magnetically permeable plate;

placing a second apertured plate over the opposite side of said coil forms in order to retain the flanges of the coil forms between the apertured plates;

winding electromagnetic coils around said coil forms;

securing a pair of magnetic coupling plates to opposite sides of said coil forms;

inserting a plurality of reed switches into said coil forms; and providing electrical connections to said reed switches.

12. A cross point switching matrix comprising:

first and second magnetically permeable plates each having a plurality of apertures formed therein;

a plurality of coil forms each having a radially extending flange, said coil forms having first and second sections extending from opposite sides of said flange, the first sections of said coil forms extending through the apertures formed in said first plate and the second sections of said coil forms extending through the apertures formed in said second plate, said plates being affixed together and retaining said flanges therebetween;

a plurality of reed switches disposed in each of said coil forms, each of said reed switches having first and second opposing ends;

a plurality of electrical windings wound around each of the first and second sections of each of said coil forms;

a first magnetically permeable coupling plate disposed adjacent to the ends of said first sections, said first magnetically permeable coupling plate having a plurality of apertures formed therein receiving the first ends of said reed switches;

a second magnetically permeable coupling plate disposed adjacent to the ends of said second sections, said second magnetically permeable coupling plate having a plurality of apertures formed therein for receiving the second ends of said reed switches;

a plurality of substantially parallel, substantially straight first electrical conductors interconnecting predetermined ones of the first ends of the said reed switches; and a plurality of substantially parallel, substantially straight second electrical conductors interconnecting predetermined ones of said second end of said reed switches, said second electrical conductors being disposed in a direction substantially perpendicular to the first conductors.

13. A cross point switching matrix as recited in claim 12 further including first and second apertured insulating plates disposed between said first coupling plate and said first conductors and between said second coupling plate and said second conductors, respectively.

14. A cross point switching matrix as recited in claim 12 wherein said coil forms are disposed on said first and second magnetically permeable plates in a rectangular array, and wherein said reed switches are aligned in a substantially straight line within said coil forms, said substantially straight lines being disposed at substantially a 45° angle to the coordinates of the rectangular array.

15. A cross point switching matrix as recited in claim 14 wherein the apertures formed in said first and second coupling plates have a direction of elongation aligned at a 45° angle with respect to the coordinates of the array and at least some of said last mentioned apertures receive the ends of the reed switches extending from more than one of said coil forms.

16. A cross point switching matrix as recited in claim 12 wherein said first electrical conductors are electrically conductive metal straps.

17. A cross point switching matrix as recited in claim 12 wherein said second conductors are printed circuit conductors disposed on a printed circuit board.

18. A cross point switching matrix as recited in claim 12 wherein one of said magnetically permeable coupling plates has a flange extending therefrom adjacent to each of said apertures.

* * * * *